US010130198B2

(12) United States Patent
Eberhard et al.

(10) Patent No.: US 10,130,198 B2
(45) Date of Patent: Nov. 20, 2018

(54) DRINKING VESSEL

(71) Applicant: VinOval GmbH, Munich (DE)

(72) Inventors: Theo Eberhard, Munich (DE); Klaus Sailer, Munich (DE)

(73) Assignee: VinOval GmbH, Munich (DE)

( * ) Notice: Subject to any disclaimer, the term of this patent is extended or adjusted under 35 U.S.C. 154(b) by 0 days.

(21) Appl. No.: 15/146,235

(22) Filed: May 4, 2016

(65) Prior Publication Data

US 2016/0242583 A1 Aug. 25, 2016

Related U.S. Application Data

(63) Continuation of application No. PCT/EP2014/073680, filed on Nov. 4, 2014.

(30) Foreign Application Priority Data

Nov. 4, 2013 (DE) ..... 10 2013 018 495

(51) Int. Cl.
*A47G 19/22* (2006.01)
*B65D 90/14* (2006.01)

(52) U.S. Cl.
CPC ..... *A47G 19/2255* (2013.01); *A47G 19/2205* (2013.01); *A47G 2400/045* (2013.01)

(58) Field of Classification Search
CPC ..... A47G 19/2255; A47G 19/2205; A47G 2400/045
USPC ..... 215/374; D7/537; 220/630
See application file for complete search history.

(56) References Cited

U.S. PATENT DOCUMENTS

| | | | | | |
|---|---|---|---|---|---|
| 456,211 | A | | 7/1891 | Anderson | |
| 1,134,354 | A | | 4/1915 | Seifke | |
| 1,421,696 | A | | 7/1922 | Kucera | |
| D115,522 | S | * | 7/1939 | Moreau | D7/537 |
| 2,256,922 | A | * | 9/1941 | Bottome | A47G 19/2205 220/710.5 |
| 2,996,208 | A | | 8/1961 | Schroeder | |
| D240,285 | S | * | 6/1976 | Sarpaneva | D7/509 |
| D240,286 | S | * | 6/1976 | Sarpaneva | D7/509 |
| 5,586,647 | A | | 12/1996 | Barta et al. | |
| D423,877 | S | * | 5/2000 | Kerr | D7/503 |
| D446,684 | S | * | 8/2001 | Price | D7/509 |
| D456,211 | S | * | 4/2002 | Price | D7/509 |
| D464,231 | S | | 10/2002 | Crowley | |

(Continued)

FOREIGN PATENT DOCUMENTS

| | | |
|---|---|---|
| CN | 103188968 A | 7/2013 |
| DE | 24 50 472 | 5/1976 |

(Continued)

OTHER PUBLICATIONS

Chinese Office Action for Chinese Application No. 201480060879.7 dated Mar. 23, 2017—English translation.

(Continued)

*Primary Examiner* — J. Gregory Pickett
*Assistant Examiner* — Niki M Eloshway
(74) *Attorney, Agent, or Firm* — Muncy, Geissler, Olds & Lowe, P.C.

(57) ABSTRACT

A drinking vessel having a bowl. The shape of the periphery of the bowl, in a horizontal cross-section, is not circular. The drinking vessel also has an axis of symmetry and a device for rotating the bowl about the axis of symmetry.

18 Claims, 6 Drawing Sheets

(56) References Cited

U.S. PATENT DOCUMENTS

| | | | | |
|---|---|---|---|---|
| 6,491,183 | B1 * | 12/2002 | Huang | A47G 19/2255 211/74 |
| D570,158 | S * | 6/2008 | Massi | D7/509 |
| D570,185 | S | 6/2008 | Massi et al. | |
| 8,101,222 | B2 | 1/2012 | Burroughs et al. | |
| 8,196,764 | B2 | 6/2012 | Bernstein | |
| D685,610 | S * | 7/2013 | Bangert | D7/524 |
| 2005/0242102 | A1 | 11/2005 | Groppo | |
| 2006/0249518 | A1 * | 11/2006 | Festa | A47G 19/2205 220/669 |
| 2008/0099364 | A1 * | 5/2008 | Niedzwiecki | A47G 19/2255 206/517 |
| 2011/0215107 | A1 | 9/2011 | Lee | |
| 2011/0297688 | A1 * | 12/2011 | Bangert | A47G 19/2205 220/710.5 |
| 2012/0205385 | A1 | 8/2012 | Crosby | |
| 2012/0233968 | A1 * | 9/2012 | Bernstein | A47G 19/2205 53/452 |
| 2013/0313271 | A1 * | 11/2013 | Speciale | A47G 19/2266 220/719 |
| 2014/0291335 | A1 * | 10/2014 | Lee | A45F 3/20 220/630 |
| 2015/0289692 | A1 * | 10/2015 | Bell | A47G 19/2288 220/592.17 |

FOREIGN PATENT DOCUMENTS

| | | | |
|---|---|---|---|
| DE | 36 12 607 | A1 | 10/1987 |
| DE | 20 2006 003 849 | U1 | 6/2006 |
| EP | 1 210 890 | A1 | 6/2002 |
| EP | 1 591 046 | A1 | 11/2005 |
| JP | H07 172 | U | 1/1995 |
| JP | 2002-045287 | A | 2/2002 |

OTHER PUBLICATIONS

Second Chinese Office Action issued by Chinese Patent Office dated Apr. 26, 2018 for corresponding Chinese application 201480060879.7.

* cited by examiner

DRINKING VESSEL

This nonprovisional application is a continuation of International Application No. PCT/EP2014/073680, which was filed on Nov. 4, 2014, and which claims priority to German Patent Application No. 10 2013 018 495.9, which was filed in Germany on Nov. 4, 2013, and which are both herein incorporated by reference.

BACKGROUND OF THE INVENTION

Field of the Invention

The present invention generally relates to drinking vessels for beverages, for example glasses. In particular, the present invention relates to drinking vessels, for example glasses for receiving alcoholic drinks.

Description of the Background Art

For consuming beverages it is known to fill beverages into drinking vessels, for example glasses, and drink the beverages out of these glasses. Moreover, it turned out that the exact design of a glass can influence, preferably increase the enjoyment of the beverage therein. For example, there are numerous different types of glasses, for example champagne glasses, wine glasses, wherein the design of these glasses can differ in view of red wine and white wine or even specific grape varieties, glasses for different beers and cognac glasses, to name but a few examples. In connection with some beverages, for example red wine, the taste experience of the wine can be increased in that the wine is mixed with air—the wine is allowed to "breathe". Normally, users move or rotate the glass so that the beverage, for example the red wine, is caused to swirl in order to achieve a suitable mixing of the wine with air. However, the resulting mixing of the wine and air is often not sufficient for the flavor of the wine to unfold completely. Therefore, often decanters are provided, in which the wine is stored before it is drunk. These decanters generally increase the surface of the wine which is in contact with air and thus lead to an increased mixing of the wine and air. However, filling the wine into a decanter is an additional step. Moreover, the wine must be stored in the decanter for a relatively long time in order to be able to unfold its flavor completely. Therefore, timely advance planning is necessary so as to be able to carry out such decantation properly. Alternative solutions relate to top pieces on bottles through which the wine flows when it is poured out so that the wine has more contact with air because it is swirling. However, the known solutions, i.a., do not allow a person-related or individual breathing of the wine. In view of the above it is desirable to provide alternative means which allow the user to mix liquid and air in a simple manner.

It is known from U.S. Pat. No. 8,101,222 B2 to provide a glass with an additional device which, when the wine is poured in, guides the wine in a specific manner in order to aerate it. DE 20 2006 003 849 U1 further discloses a glass comprising swirling means for swirling the liquid.

However, the prior art solutions are related with various problems and deficiencies. For example, these glasses comprise additional elements, so that their design and production is additionally more complicated. Furthermore, users are often of the opinion that these additional elements are aesthetically little attractive and disturb functionality. Moreover, these additional devices increase the respective glasses' susceptibility to breaking and make cleaning more difficult. Moreover, it cannot be excluded that during cleaning a user who does not expect such devices in the glasses gets hurt.

SUMMARY OF THE INVENTION

It is therefore an object of the present invention to overcome or reduce the problems and deficiencies of the prior art. For example, it is an object of the present invention to provide a drinking vessel which allows the user an improved, simple and feasible mixing of liquids and air in the drinking vessel. Furthermore, the drinking vessel should be easily producible, optically attractive as well as easily manageable and cleanable.

In other words, the objects are achieved by a drinking vessel, for example a glass for beverages. Typically, glasses of this kind are made mainly from silicon dioxide and are translucent. This is advantageous in particular in connection with an embodiment of the drinking vessel as a wine glass, for example in view of taste, quality rating and hygiene. However, it is clear to the person skilled in the art that also other materials can be used for producing a drinking vessel, for example a ceramic material or also a plastic material which can be, for example, at least partly translucent. The drinking vessel according to the invention comprises a bowl. A bowl is generally understood to be the area of the glass into which liquid can be filled. According to an exemplary definition, the bowl does not have a completely flat bottom but preferably a tapering and/or inclined bottom. Optionally, for example in case the glass is configured as a wine or cognac glass, the glass can have a stem. Then it can also have a foot, but it does not necessarily have to. The bowl further has a horizontal, non-circular cross-section in all areas or in a partial area. A horizontal cross-section can be understood to be a cross-section being parallel to the horizontal when the drinking vessel is placed as intended. In particular, the course of the inner wall of the drinking vessel which is in contact with the liquid in the drinking vessel and which is herein also referred to as shape of the periphery (also peripheral shape) or shape of the inner periphery (also inner peripheral shape) is not circular. It turned out that a non-circular shape of the periphery, in particular a non-circular shape of the inner periphery of the bowl clearly increases mixing of the liquid or beverage in the drinking vessel and thus in particular its contact with air when the drinking vessel is rotated. For example, this can be caused in that the liquid does not rotate uniformly in a circular drinking vessel but swirls are caused because of the non-circular peripheral shape. These swirls preferably cause an increased mixing of the beverage with air, for example by an increased mixing of the surface of the liquid or beverage, in particular with the below layers of the liquid. Thus, a drinking vessel is provided which allows an increased and more rapid mixing of liquid in the drinking vessel with air as compared to the prior art. At the same time, the drinking vessel preferably can be designed in an optically attractive manner, can be produced easily, can be handled easily, can be cleaned easily, and the risk of injury is reduced as compared to the glasses of the above-mentioned prior art documents. In particular, it is also preferred that the interior of the bowl is smooth, i.e. does not comprise any additional elements or the like.

The described non-circular periphery can be, e.g., oval or elliptical.

Moreover, in an area of the bowl, the drinking vessel can have one (or also more) second horizontal cross-section(s), for example a shape of the inner periphery at a second horizontal cross-section which is circular. In other words, the glass according to this embodiment can thus have in a partial area of the bowl a first cross-section having a non-circular shape of the periphery and in a second partial area of the bowl a cross-section having a circular shape of the periphery. For example, the circular horizontal cross-section can be arranged at an upper rim or in an upper area of the bowl. Thus, the area which comes in contact with the mouth of the user when he/she is drinking can have the uniform and circular shape the user is familiar with so that user-friendliness is thus further increased. However, it is also possible that the upper rim, in a horizontal cross-section, is oval or elliptical. Additionally or alternatively, the drinking vessel can have two or more horizontal cross-sections having cross-sectional shapes which are different from one another, for example have different oval or elliptical or circle shapes.

In a first side view of the drinking vessel, the drinking vessel can have a first maximum horizontal inner diameter and in a second side view it can have a second maximum horizontal inner diameter being different from the first maximum horizontal inner diameter. Preferably, the directions of these two top views are perpendicular with respect to each other, i.e. in particular the directions of the top views are understood to be vectors that are perpendicular with respect to one another. Furthermore, the directions or vectors preferably lie in one plane or in planes extending parallel with respect to each other. Furthermore, it is preferred that the drinking vessel has at least one axis of symmetry. Preferably, each described top view is in a direction perpendicular thereto (i.e. the (direction) vectors are perpendicular with respect to the axis of symmetry). The axis of symmetry can be a 180° rotational axis of symmetry. This means that when the drinking vessel is rotated by 180° about this axis, it is again congruent with itself.

The described first and second maximum horizontal inner diameters can be arranged at the same height. Preferably, the first maximum horizontal inner diameter and/or the second maximum horizontal inner diameter is/are arranged in a lower half (relative to its height) of the bowl of the drinking vessel and more preferably in a lower third of the bowl of the drinking vessel. In other words, the drinking vessel or its bowl thus can provide for a relatively wide "bulge" in the lower area of the drinking vessel or bowl. The first maximum horizontal inner diameter can preferably be larger by a factor of 1.05 to 2.5, particularly preferably 1.1 to 2 and for example about 1.5 than the second maximum horizontal inner diameter. The mentioned dimensions turned out to be particularly and preferably specifically suitable for allowing a sufficient rotation with at the same time a sufficient swirling of the liquid in the drinking vessel when the glass is rotated.

Furthermore, the drinking vessel or the bowl can taper towards the top. For example, the drinking vessel can taper upwardly towards the upper rim so that there is no area between the upper rim and the bulgy area of the drinking vessel which has a smaller diameter than the upper rim. However, it is also possible that the drinking vessel comprises a waist area. Starting from the area with the maximum horizontal inner diameter, the drinking vessel preferably tapers towards the top, at first up to the waist area. From the waist area to the upper rim, the drinking vessel has either a constant diameter or preferably widens again. Thus, at the upper rim or in a waist area, the drinking vessel can have, in the first view, also a first upper horizontal inner diameter or a first waist diameter which is smaller than the first horizontal inner diameter. Preferably, these two (i.e. the first upper horizontal inner diameter or the first waist diameter on the one hand and the first maximum horizontal inner diameter on the other hand) differ by a factor of 1.05 to 3, more preferably by a factor between 1.1 and 2, for example by a factor of about 1.5.

Likewise, in the second view, the drinking vessel can have a second upper horizontal inner diameter or a second waist diameter at the upper rim or in the waist area which is smaller than the second maximum horizontal inner diameter. Preferably, these two differ by a factor between 1.1 to 2.5.

Because of these features—in particular because of the tapering towards a waist area or towards the upper rim—liquid in the drinking vessel can be prevented from exiting the drinking vessel when the drinking vessel is rotated. This is particularly advantageous because due to the swirls during rotation this risk can be higher because of the non-circular diameter than in a circular drinking vessel. At the same time, aromas can preferably be kept in the drinking vessel, thus increasing enjoyment. Finally, a suitable transition to a circular peripheral shape can be provided at the rim.

The bowl can have a substantially constant thickness. This can be particularly advantageous in terms of manufacturing. Preferably, the drinking vessel has, at least in some horizontal cross-sections, a proportional outer periphery corresponding to the inner periphery. Preferably, mouth-blown glasses have, at places with non-circular cross-section, an irregular structure change in the glass at the narrowest place on the opposing outer sides. These structure changes can mainly be due to manufacturing. In particular in connection with mouth-blown glasses, the desired non-circular cross-section can be achieved by flattening two opposing sides for some time during the process of manufacturing.

Furthermore, the shape of the outer periphery of the drinking vessel can be circular in the horizontal cross-section in which the drinking vessel has a non-circular inner periphery. For example, in each horizontal cross-section, the drinking vessel can have an outer periphery which is circular. In this embodiment, the wall thickness is preferably different in the peripheral and height directions. In this embodiment, the drinking vessel has, in view of its outer appearance, the normal appearance of a drinking vessel, for example the glass. In particular, it is not readily apparent from the outside that the drinking vessel has a non-circular inner periphery. This can be advantageous in view of aesthetics, but also in view of packaging, storing and stability. It is mainly suitable for machine-made glasses, for example cast or pressed glasses.

Moreover, the drinking vessel can have a stem and/or a foot. The stem and foot can be designed as known from the prior art. However, the stem can also have a first stem portion and a second stem portion which can be rotated relative to one another. It is also possible that the drinking vessel has a stem, wherein the stem has a first and a second foot portion which can be rotated relative to one another. It is also possible that the drinking vessel is provided with a drinking vessel holder having different parts or portions which can be rotated relative to one another. It is also possible that the drinking vessel has only a stem but no foot and that the drinking vessel can be placed in a separate holder when it is not used. This can further facilitate the rotation of the drinking vessel which causes the rotation of the liquid in the drinking vessel. In general, the drinking vessel can have two portions which can be rotated relative to one another.

According to an embodiment, the drinking vessel can comprise in particular a device for rotating the bowl. It can be arranged at the axis of symmetry of the drinking vessel and, therefore, allow in particular rotation about the axis of symmetry. The device for rotating the bowl can in particular be a stem. The stem can be firmly connected to a foot of the drinking vessel. In a further embodiment, the foot can have a pin in its center. This pin extends the stem beyond the standing surface of the foot by few a micrometers to a maximum of some millimeters. Thus, the glass is no longer standing on the entire bottom of the foot but can be rotated on the pin like a spinning top without falling over because the drinking vessel is further secured by the foot when the glass is let go of. However, the stem can also be provided without the foot.

The device for rotating the drinking vessel can also be realized, e.g., by a base which can fix the bowl and can then be caused manually or electrically to rotate so that the bowl moves about its axis of symmetry.

Mixing can be achieved in that the drinking vessel is caused to rotate by rotation. This changes the normal use of movement of, e.g. a wine glass but is advantageous in that the different planes of the liquid in the drinking vessel are mixed better so that the addition of oxygen is increased for the entire liquid.

In general, the drinking vessel can be configured to cause a considerable mixing of the liquid in the drinking vessel with gas, for example air, when the drinking vessel is moved and preferably rotated.

Alternatively or additionally, the following aspects are described: a drinking vessel for beverages, wherein the drinking vessel comprises a bowl which, in a horizontal cross-section, has a peripheral shape which is not circular. The peripheral shape can be an inner peripheral shape of the drinking vessel. The peripheral shape can be oval or elliptical. In a second horizontal cross-section, the drinking vessel can have an inner peripheral shape which is circular. The drinking vessel can have an upper rim which, in a horizontal cross-section, is circular. The drinking vessel can have an upper rim which, in a horizontal cross-section, is oval or elliptical. In a first side view, the drinking vessel can have a first maximum horizontal inner diameter and in a second side view a second maximum horizontal inner diameter being different from the first maximum horizontal inner diameter. A direction of the first view can be substantially perpendicular with respect to a direction of the second view and/or wherein the glass can have at least a longitudinal axis and/or an axis of symmetry and each view is in a direction perpendicular thereto.

Also, the first maximum horizontal inner diameter can be at the same height as the second maximum horizontal inner diameter. The first maximum horizontal inner diameter and/or the second maximum horizontal inner diameter can be arranged in a lower half of the bowl of the drinking vessel and preferably in a lower third of the bowl of the drinking vessel. The first maximum horizontal inner diameter can be larger by a factor of 1.05 to 2.5 than the second maximum horizontal inner diameter.

Additionally, in the first view, at the upper rim or in a waist area the drinking vessel can further have a first upper horizontal inner diameter or a first waist diameter which can be smaller than the first maximum horizontal inner diameter and wherein said two preferably differ from each other by a factor of 1.05 to 3. In the second view, at the upper rim or in the waist area the drinking vessel can have a second upper horizontal inner diameter or a second waist diameter which is smaller than the second maximum horizontal inner diameter and wherein said two preferably differ from each other by a factor of 1.05 to 3. The drinking vessel can taper towards the top.

Further, the drinking vessel can comprise a bowl and a stem. The drinking vessel can also comprise a bowl, a stem and a foot. The drinking vessel can be a glass, for example a wine glass. The drinking vessel can comprise a bowl having a substantially constant thickness. In the horizontal cross-section in which the inner periphery has a non-circular shape, an outer peripheral shape of the drinking vessel can be circular. The shape of the outer periphery of the drinking vessel can be circular in each horizontal cross-section and wherein preferably a wall thickness of the drinking vessel is different in the peripheral and height directions.

The drinking vessel can comprise a stem and the stem has a first stem portion and a second stem portion which can be rotated relative to one another. The drinking vessel can also comprise a foot and the foot has a first foot portion and a second foot portion which can be rotated relative to one another. The drinking vessel can further comprise a holder with different parts or portions which can be rotated relative to one another. The drinking vessel can be configured to cause a considerable mixing of the liquid in the drinking vessel with gas when the drinking vessel is rotated or moved. The drinking vessel can comprise a device for rotating the bowl and wherein the device for rotating the bowl can be a stem and, for example, a stem without foot.

The drinking vessel can have an axis of symmetry, in particular a 180° rotational axis of symmetry. The device for rotating the bowl can be arranged at the axis of symmetry and/or allows rotation about the axis of symmetry. The device for rotating the bowl can be a stem and, for example, a stem without foot. The vessel can comprise a stem, for example a stem with a foot, wherein the stem can be straight and/or elongate.

The drinking vessel can comprises a bowl and a stem. The drinking vessel can comprises a foot. The drinking vessel can comprise two portions which can be rotated relative to one another.

Also, the drinking vessel can haves an axis of symmetry which defines a longitudinal direction, wherein, in the first view, the inner diameter defines a first curve relative to the longitudinal direction and wherein, in the second view, the inner diameter defines a second curve relative to the longitudinal direction and wherein the first curve and the second curve have different inclinations in at least one place in the longitudinal direction and preferably have different inclinations in a plurality of places.

Further scope of applicability of the present invention will become apparent from the detailed description given hereinafter. However, it should be understood that the detailed description and specific examples, while indicating preferred embodiments of the invention, are given by way of illustration only, since various changes, combinations and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
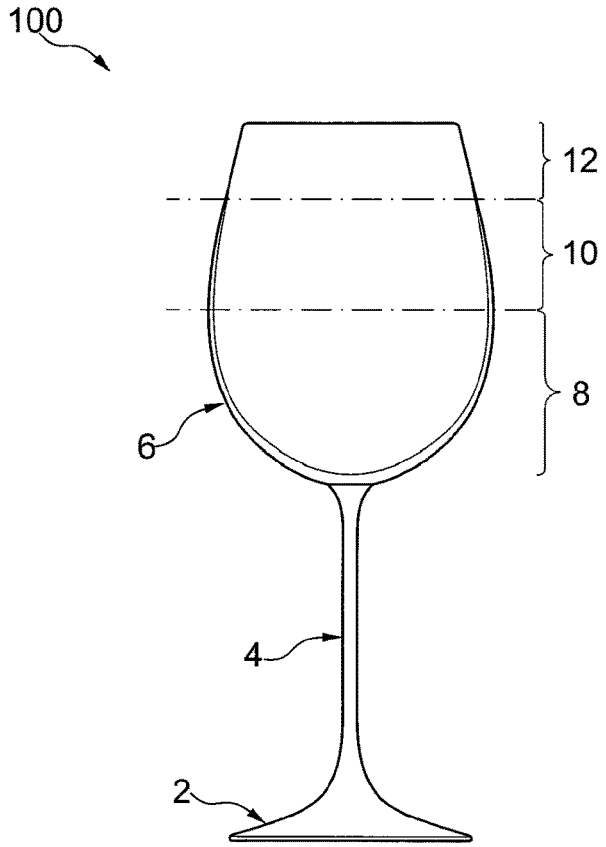
FIG. 1 shows a schematic side view of a conventional wine glass.

FIG. 1 shows a glass, for example a wine glass, from the prior art. Such a wine glass 100 normally comprises a foot 2 on which it can be placed, a bowl 6 for receiving liquid, for example wine, as well as a stem 4 which connects the foot 2 to the bowl 6 and is generally configured as a thin, bar-shaped element. The bowl 6 comprises different areas—for example a lower or wetted area 8, a swirl-wetted area 10 as well as a drink-wetted area 12. The wetted area 8 is the area which is filled with and thus comes in contact with the liquid, for example red wine, during normal use. In other words, red wine is poured into the bowl 6 in such a manner that the red wine is located only in the lower wetted area 8 but the filling level is not so high that wine is present in areas 10 and 12 when the glass 100 is standing. The wetted area 8 is adjoined by the area 10 which can also be referred to as second area or swirl-wetted area 10. Adjacent thereto, more exactly adjacent to the top when the glass 100 is standing on the foot 2, there is an upper or drink-wetted area 12 which ends in an upper glass rim 14. During normal use, liquid, for example red wine, is filled into the bowl 6 so that it is in area 8 during normal use when the glass 100 is standing normally, for example on a table. In connection with some beverages, for example red wine, it is particularly desired that it is mixed with a gas, for example air or oxygen, in order to further improve the taste of such a wine—this procedure is generally also called "breathing" of the wine. For causing such a mixing of the liquid or the beverage with gas, for example air, many users rotate or move the wine glass 100. Caused by the movement and the resulting centrifugal forces, the wine thus moves upwardly within the bowl 6 and reaches the swirl-wetted area 10 (which is thus wetted during swirling). Thus, the surface of the wine 10 is increased, leading to an improved mixing of the wine with air. Furthermore, also additional turbulences during such swirling cause a good mixing of the wine so that much wine comes in contact with the air. Since the wine comes into this middle area 10 of the bowl 6 when the glass 100 is moved, this middle area is also called swirl-wetted area 10. When the user drinks the wine in the glass 100, he/she tilts the entire glass 100 in such a manner that the upper glass rim 14 is moved out of the horizontal. The wine then flows across the swivel-wetted area 10 and the drink-wetted area 12 into the mouth of the user and can be enjoyed by him/her. Therefore, the upper area 12 can also be called drink-wetted area 12. On the basis of such "normal" glasses, it is in particular an object of the present invention to provide a glass which can unfold the aroma of a beverage in an improved manner.

This object can be achieved, i.a., in that a drinking vessel is provided which guarantees better mixing of the beverage with air. Individual embodiments will be described in the following.

Figure 2C:
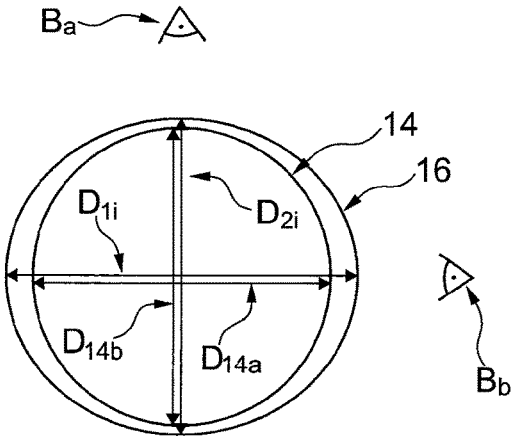
FIG. 2*c* shows a top view of the drinking vessel according to the embodiments of FIGS. 2*a* and 2*b;*
Figure 2A:
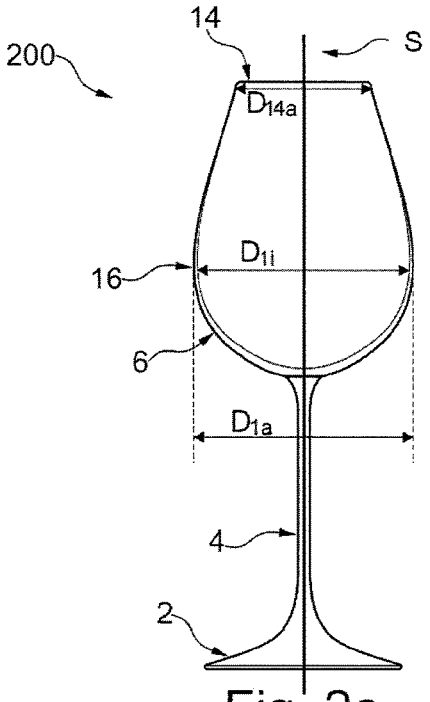
FIG. 2*a* shows a first side view of a drinking vessel according to an embodiment of the present invention.
Figure 2B:
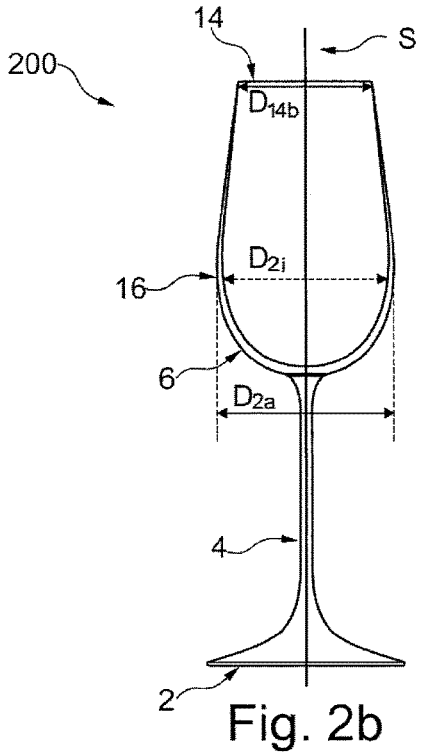
FIG. 2*b* shows a second side view of the drinking vessel shown in FIG. 2*a* according to a first embodiment of the present invention.

FIGS. 2*a*, 2*b* and 2*c* show a first embodiment of a drinking vessel 200. This drinking vessel 200 can be configured as glass 200. In the description of the preferred embodiments, generally always glasses 200, 300, 400, 500 will be mentioned. However, this should not be understood as being restrictive. Rather, the person skilled in the art will understand that the features of the embodiments described herein can also be realized with other drinking vessels. As described above, also this glass 200 can have a foot 2, a stem 4 and a bowl 6. In the shown embodiment, the bowl 6 has a glass bulge 16. The glass bulge 16 is the area in which the bowl 6 has a maximum horizontal diameter. In the shown side view of FIG. 2*a*, the bowl 6 tapers towards the top so that a horizontal diameter in an upper or drink-wetted area of the glass, for example at the upper glass rim 14, can be clearly smaller than a diameter at the glass bulge 16. In the following, an embodiment in which, in a top view, the diameter is minimal at the upper glass rim 14 will be exemplarily discussed and shown in the Figures; however, this is not necessarily the case. It is also possible that the glass tapers towards an upper waist area and then widens again above this waist area. If a waist area is provided, a diameter of the waist area is preferably between 1.05 and 1.3 times smaller than a diameter at the upper glass rim 14. It is also possible that a diameter tapers up to such a waist area and from there on is constant up to the upper glass rim 14. A diameter D1*i* at the glass bulge can, for example, be between 1.05 and 3, preferably between 1.1 and 1.7, for example about 1.5 times as large as a diameter at the upper glass rim 14 or at the waist area. Furthermore, the embodiment shown in FIG. 2*a* shows, in addition to the inner diameter at the glass bulge 16, also the outer diameter D1*a* at the glass bulge 16. They differ by twice a glass thickness or a wall thickness in this area.

FIG. 2*b* shows a second side view of the glass 200. The side view of FIG. 2*b* is rotated by 90° relative to the side view of FIG. 2*a*. The viewing directions of FIGS. 2*a* and 2*b* are also shown in FIG. 2*c*, wherein the viewing directions for FIGS. 2*a* and 2*b* are shown by the symbols with the reference signs Ba and Bb. According to the illustration of FIG. 2*b*, in this second side view the glass 200 has a smaller diameter at the glass bulge 16 than in the first side view according to FIG. 2*a*. In other words, thus the inner diameter D2*i* of this side view is smaller than the respective inner diameter D1*i* in the other side view and also the outer diameter D2*a* is smaller than the respective outer diameter D1*a* in the side view shown in FIG. 2*a*. Furthermore, it is preferred that also in the side view shown in FIG. 2*b* the inner diameter D2*i* at the glass bulge 16 is larger than the inner diameter D14*b* at the upper glass rim 14 or at the waist area. For example, in this side view the inner diameter D2*i* at the glass bulge 16 can be between 1% and 200%, preferably between 2% and 50%, for example about 10% larger than the inner diameter D14*b* at the upper glass rim 14. However, it is not necessary that both diameters at the bulge are larger than the diameter at the upper rim, in particular this is not necessary if the rim is round. It can also be the case that only the larger diameter of the bulge is larger than the diameter of the upper rim.

As a result, this means that, in a horizontal cross-section along the bulge 16, the glass 200 has an oval and preferably an elliptical shape. The upper glass rim 14 can, like the bulge, have an oval or elliptical shape, but with a smaller diameter. However, also the upper glass rim 14 can have a round shape, so that the inner diameters D14*a* and D14*b* are identical in the two shown side views of FIGS. 2*a* and 2*b*. In the area of the upper glass rim 14 or in the waist area, thus a round shape which is known to the user would be guaranteed, which can be particularly advantageous. The oval design of a cross-section through the bowl 6, in particular in the wetted or swirl-wetted area, leads to the fact that when moving the glass in order to allow the wine to "breath", particularly great or particularly suitable turbulences are caused in the glass leading to an increased mixing of the beverage, for example the red wine, with the air. Thus, the aroma of the wine can be emphasized particularly well. Furthermore, the tapering of the bowl 16 towards the top, i.e. the fact that the inner diameters D14*a* and D14*b* of the upper glass rim 14 or in the waist area are smaller than the respective diameters D1*i* and D2*i* at the glass bulge, can lead to the fact that the wine is protected from exiting the glass towards the top when the wine is swirling. This can allow a particularly high rotational or swirling speed or intensity, which allows particularly high turbulences and thus again contributes to an increased mixing of the wine with the air and further improves the aroma.

Furthermore, in FIGS. 2*a* and 2*b* the axis of symmetry S of the drinking vessel 200 is emphasized—although such an axis of symmetry is also present in the embodiments of the other Figures, it is shown only in FIGS. 2*a* and 2*b* for the sake of clarity. In particular, the axis of symmetry S can extend along a height of the drinking vessel 200, i.e. in the vertical direction, when the drinking vessel 200 is placed as intended on a horizontal plane or is held as intended. Along the axis of symmetry S, the drinking vessel 200 has a varying inner diameter in both top views. If, for both views, the respective inner diameter is drawn in along the axis of symmetry S (or against the position in the height or vertical direction), a respective curve is obtained: Inner diameter in the first or in the second view vs. position in the vertical direction. They preferably differ such that the curves of the first and the second view have different inclinations in at least one place (and preferably in a plurality of places).

Figure 3A:
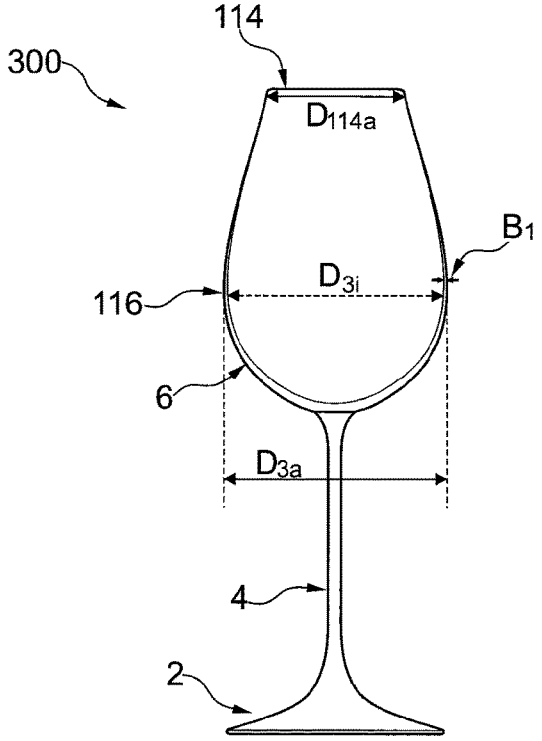
FIG. 3*a* shows a first side view of a drinking vessel according to a further embodiment of the present invention.
Figure 3B:
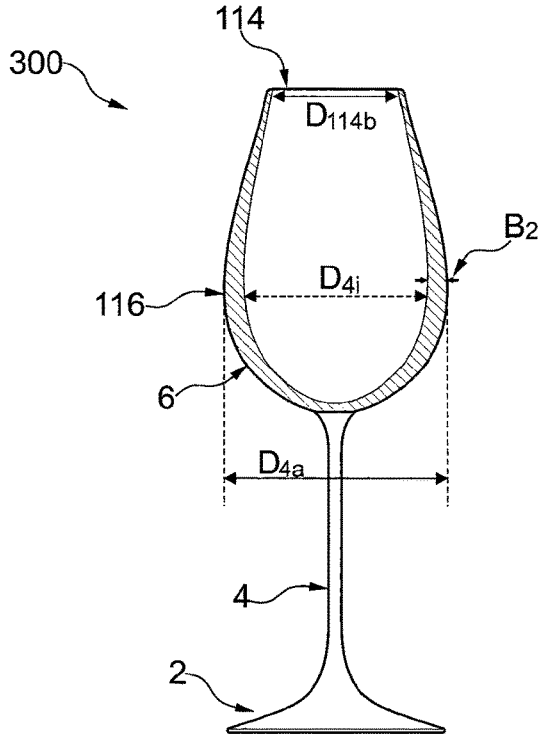
FIG. 3*b* shows a second side view of the drinking vessel of the invention according to the embodiment shown in FIG. 3*a;*
Figure 3C:
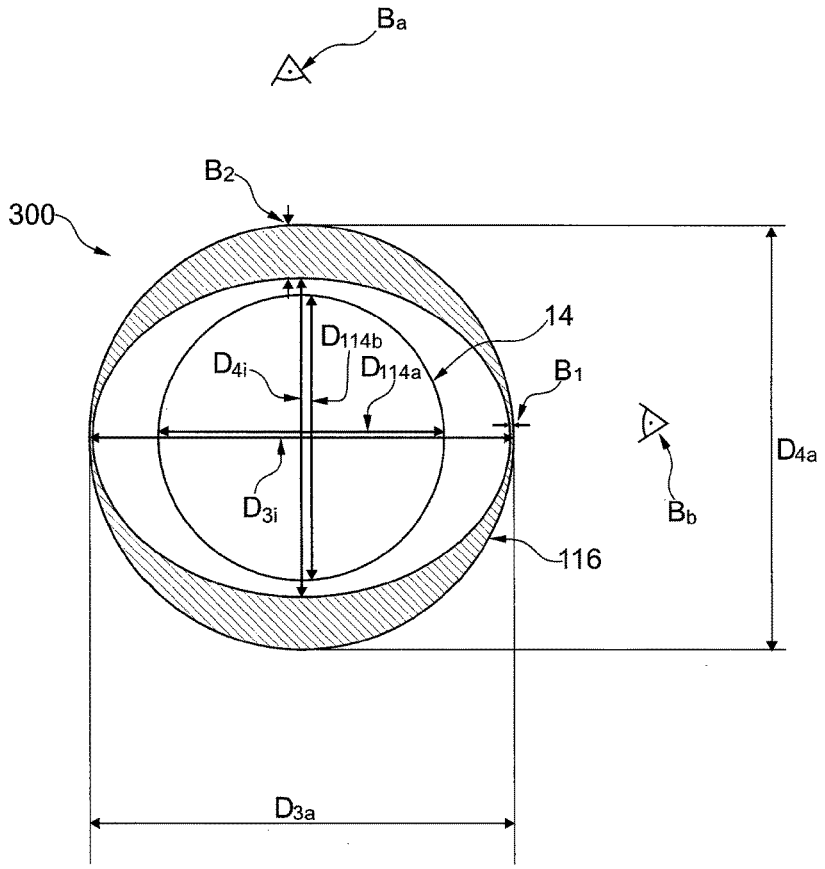
FIG. 3*c* shows a top view of a drinking vessel according to the embodiment shown in FIGS. 3*a* and 3*b;*

FIGS. 3*a*, 3*b* and 3*c* show a second embodiment of the present invention. The same or similar elements have the same reference signs as in the previous Figures or similar ones. Not any element is discussed in detail if it is identical to that of the previously described Figures. The embodiment shown in FIGS. 3*a* to 3*c* shows a drinking vessel 300, which is configured, e.g., as a glass and which again comprises a foot 2, a stem 4 and a bowl 6. The bowl 6 comprises a glass bulge 116. In a first side view, which is shown in FIG. 3*a* (in view of the viewing direction, reference is again made to the structure with reference sign Ba in FIG. 3*c*), the glass 300 has an inner diameter D3*i* and an outer diameter D3*a* at the glass bulge 116. This inner diameter D3*i* is larger by twice a first glass thickness B1 than the outer diameter D3*a*. Furthermore, in the shown embodiment the bowl 6 tapers towards the top so that a horizontal diameter D114*a* at the upper glass rim 114 or in a waist area is smaller than the inner diameter D3*i* at the glass bulge 116. In view of the possible dimensions thereof, reference is made to the embodiment discussed last. A second side view of the embodiment shown in FIG. 3*a* is shown in FIG. 3*b*—in view of the respective "viewing direction", reference is again made to FIG. 3*c*. As evident from FIG. 3*b*, also in this cross-section, the glass 300 comprises a glass bulge 116 at which the inner diameter D4*i* and/or the outer diameter D4*a* is maximum. The respective inner diameter D4*i* is again smaller by twice a glass thickness B2 than the outer diameter D4*a*. In particular, the inner diameter D4*i* at the glass bulge 116 of the embodiment shown in FIGS. 3*b* and 3*a* is smaller than the respective inner diameter D3*i* at the glass bulge 116 shown in FIG. 3*a*. See also FIG. 3*c* in this regard. In view of the inner diameter or in view of the glass limits in the interior of the bowl 6, this again leads to an oval cross-sectional shape (see FIG. 3*c*). With reference to FIG. 3*b* it is further preferred that also in this view the inner extension, i.e. the inner diameter of the bowl 6, tapers towards the top so that the inner diameter D4*i* at the glass bulge 116 is larger than the inner diameter D114*b* at the upper glass rim 114 or in a waist area.

The upper glass rim 114 can have a round course so that in particular also the inner diameters D14*a* according to FIGS. 3*a* and D14*b* according to FIG. 3*b* are identical, as shown in FIG. 3*c*. Furthermore, particularly for optical and aesthetic reasons it is also preferred that the cross-section at the glass bulge 116 is round in view of its shape of the outer periphery or its outer dimensioning. This means that in particular also the outer diameters D3*a* and D4*a* are identical. It is further particularly preferred that this does not only apply to the cross-section through the glass bulge 116 but to all cross-sections. This means that in accordance with a particularly preferred embodiment, the shape of the outer periphery of the glass 300 is at least substantially circular in each place. Thus, it is possible to provide a glass which has the above functionalities and is similar or equal to a "typical" wine glass in view of visual appearance and aesthetics.

Figure 4A:
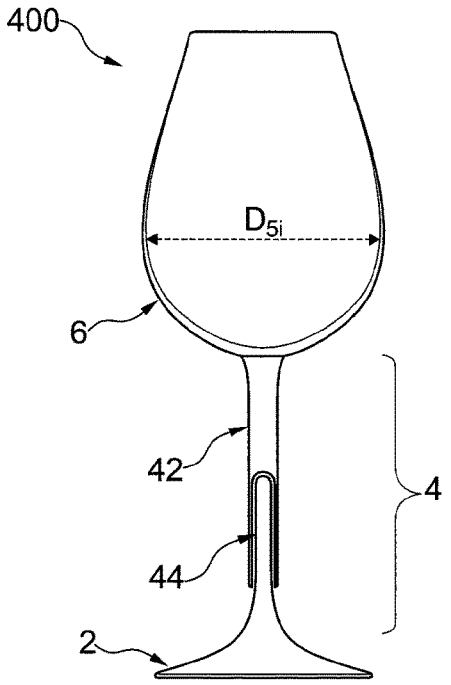
FIG. 4*a* shows a first side view of a further embodiment of the present invention.
Figure 4B:
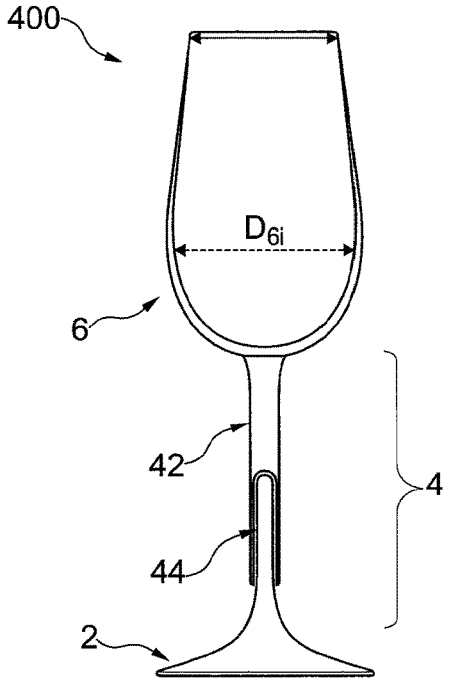
FIG. 4*b* shows a second side view of a drinking vessel according to the embodiment shown in FIG. 4*a*.

Furthermore, reference is made, e.g., to the drinking vessel 400, which is realized as a glass, according to the embodiment shown in FIGS. 4*a* and 4*b*. According to the illustrations, the bowl 6 of the glass can be configured in the same manner as in the embodiment of FIGS. 2*a*, 2*b* and 2*c*. However, it is of course also possible that the bowl 6 of the glass 400 is designed in accordance with the embodiment shown and discussed in FIGS. 3*a*, 3*b* and 3*c*. Therefore, the design of the bowl 6 will not be discussed in detail in the following. The embodiment shown in FIGS. 4*a* and 4*b* further again comprises a stem 4 and a bowl 6. The stem 4 of this embodiment has a first or upper stem portion 42 and a second or lower stem portion 44. The first stem portion 42 can be connected firmly to the bowl 6 and preferably can be formed integrally therewith. The lower stem portion 44 in turn is firmly connected to the foot 2 and is preferably integrally formed therewith. The two stem portions are provided so as to be rotatable relative to one another. In other words, a rotating mechanism is provided by means of which the bowl 6 and the upper stem portion 42 can be rotated independently of the foot 2 and the lower stem portion 44. In this embodiment, the glass 400 can thus be left standing while nevertheless the upper stem portion 42 and the bowl 6 can be moved so that the wine is swirled.

It is also possible that the rotating mechanism is not arranged between parts of the stem 4 but between the stem 4 and the foot 2 and that these are provided so as to be rotatable relative to one another. In such an arrangement, the stem 4 might be inserted into the foot 2, for example. It is also possible that the foot has different foot portions which can be rotated relative to one another or that the entire glass including the foot 2 is standing on a base which has such a rotating device that a part remains standing firmly on the table and another part, on which the glass (with foot 2) is standing, can be rotated about the lower "table part".

Figure 5A:
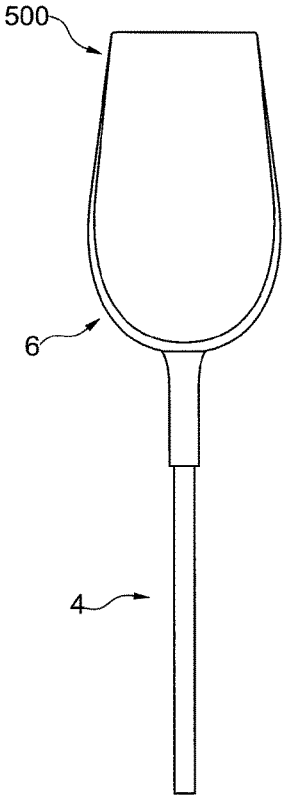
FIGS. 5*a-c* show side views of a further embodiment of the present invention.
Figure 5B:
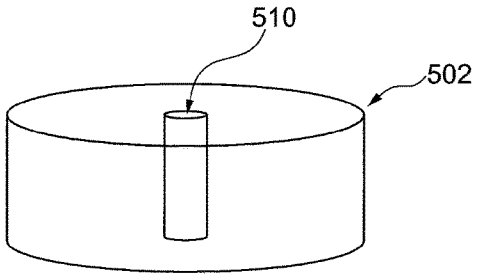
Figure 5C:
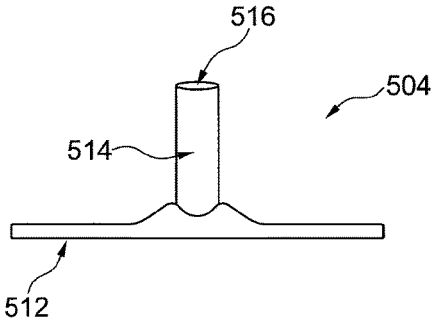

A further possibility of facilitating rotation of the glass is achieved in that the drinking vessel 500, which is realized, e.g., as a glass (as shown in FIG. 5), comprises only a bowl 6 and a stem 4 or is composed thereof. In particular, such a glass does not have a foot 2 which is firmly connected to a stem. The bowl can be designed as described above in view of the other embodiments. When not being used, the stem 4 can be inserted in a holder 502, 504 provided for this purpose. This holder can be configured either like a block, for example like a cylinder-shaped block 502 with a channel 510 into which the stem 4 of the glass can be inserted. Alternatively, the holder 504 can also be designed like a glass foot, i.e. comprise a foot portion 512 and a stem portion 514, which in turn comprises a channel 516 for receiving the glass stem 4.

It is evident to the person skilled in the art that the individual features described in connection with the different preferred exemplary embodiments can also be provided in other embodiments or can be combined with such embodiments.

The invention also comprises the precise or exact expressions, features, numerical values or ranges, etc. if above or below these expressions, features, numerical values or ranges have been mentioned in connection with expressions such as "about, approx., around, substantially, in general, at least, not less than" etc. (i.e. "about 3" should also comprise "3" or "substantially radial" should also comprise "radial"). The term "or" may also mean "and/or".

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A drinking vessel comprising:

a bowl comprising:

a top open portion;

a bottom portion; and a bulge disposed between the top open portion and the bottom portion, the bulge defining a bulge area in which the bowl has a maximum horizontal diameter, wherein, in a horizontal cross-section in the bulge area, the bowl has a peripheral shape that is not circular, wherein the bowl is tapered toward the top open portion such that a horizontal diameter at the top open portion is smaller than the maximum horizontal diameter, and wherein the bowl has a greater oblateness in the bulge area than in the top open portion;

an axis of symmetry; and a device for rotating the bowl about the axis of symmetry, wherein the drinking vessel is rotationally symmetric about the axis of symmetry, and wherein the device for rotating the bowl is aligned with the axis of symmetry.

2. The drinking vessel according to claim 1, wherein the peripheral shape is oval.

3. The drinking vessel according to claim 2, wherein in the horizontal cross-section in which the inner periphery has a non-circular shape, an outer peripheral shape of the drinking vessel is circular.

4. The drinking vessel according to claim 2, wherein the shape of the outer periphery of the drinking vessel is circular in each horizontal cross-section, and wherein a wall thickness of the drinking vessel varies along a peripheral direction of the drinking vessel and along a height direction of the drinking vessel.

5. The drinking vessel according to claim 1, wherein the peripheral shape is elliptical.

6. The drinking vessel according to claim 1, wherein the drinking vessel has an upper rim which, in a horizontal cross-section, is circular.

7. The drinking vessel according to claim 1, wherein the drinking vessel has an upper rim which, in a horizontal cross-section, is oval or elliptical.

8. The drinking vessel according to claim 1, wherein, in a first side view, the drinking vessel has a first maximum horizontal inner diameter and, in a second side view, a second maximum horizontal inner diameter being different from the first maximum horizontal inner diameter, and wherein the first maximum horizontal inner diameter is larger by a factor of 1.05 to 2.5 than the second maximum horizontal inner diameter.

9. The drinking vessel according to claim 8, wherein a direction of the first view is perpendicular with respect to a direction of the second view and/or wherein each view is in a direction perpendicular to the axis of symmetry.

10. The drinking vessel according to claim 8, wherein the first maximum horizontal inner diameter is at the same height as the second maximum horizontal inner diameter, wherein the first maximum horizontal inner diameter and/or the second maximum horizontal inner diameter is/are arranged in a lower half of the bowl of the drinking vessel.

11. The drinking vessel according to claim 8, wherein, in the first view, at the upper rim or in a waist area the drinking vessel further has a first upper horizontal inner diameter or a first waist diameter which is smaller than the first maximum horizontal inner diameter and wherein said two differ from each other by a factor of 1.05 to 3.

12. The drinking vessel according to claim 1, wherein the drinking vessel is a glass or a wine glass.

13. The drinking vessel according to claim 1, wherein the drinking vessel comprises a bowl having a substantially constant thickness.

14. The drinking vessel according to claim 1, wherein the device for rotating the bowl is a stem or a stem without foot.

15. The drinking vessel according to claim 1, wherein the drinking vessel comprises a bowl, a stem and a foot.

16. The drinking vessel according to claim 1, wherein the drinking vessel comprises a stem and the stem has a first stem portion and a second stem portion which can be rotated relative to one another.

17. A drinking vessel, comprising:

a bowl, the bowl comprising:

a top open portion;

a bottom portion; and a bulge disposed between the top open portion and the bottom portion, the bulge defining a bulge area in which the bowl has a maximum horizontal diameter, wherein the bowl is tapered toward the top open portion such that a horizontal diameter at the top open portion is smaller than the maximum horizontal diameter, and wherein the bowl has a greater oblateness in the bulge area than in the top open portion;

a foot; and a stem extending from a bottom of the bowl, the stem comprising:

an upper stem portion fixed to the bowl; and a lower stem portion fixed to the foot, wherein the upper stem and the lower stem are rotatable relative to each other about an axis of symmetry of the drinking vessel.

18. The drinking vessel according to claim 17, wherein the drinking vessel is rotationally symmetric about the axis of symmetry.

* * * * *